United States Patent [19]

Richmond et al.

[11] Patent Number: 4,517,903

[45] Date of Patent: May 21, 1985

[54] SOLID FUEL FURNACE

[75] Inventors: Iain J. Richmond; David Wong, both of Orillia; Ants Puust, Scarborough; James A. Oldham, Bolton, all of Canada

[73] Assignee: Hunter Enterprises Orillia Limited, Orillia, Canada

[21] Appl. No.: 499,949

[22] Filed: Jun. 1, 1983

[51] Int. Cl.[3] ..... F25B 7/00

[52] U.S. Cl. ..... 110/233; 110/102; 110/110; 110/118; 110/313; 126/99 R

[58] Field of Search ..... 110/105, 102, 118, 256, 110/313, 110, 234, 233; 126/99 R

[56] References Cited

U.S. PATENT DOCUMENTS

| | | | |
|---|---|---|---|
| 715,494 | 12/1902 | Maslin et al. | 110/118 |
| 4,102,278 | 7/1928 | McManama | 110/105 |
| 4,312,278 | 1/1982 | Smith et al. | 110/102 X |

*Primary Examiner*—Edward G. Favors

*Attorney, Agent, or Firm*—Hirons, Rogers & Scott

[57] ABSTRACT

A furnace using pelletized wood as a fuel and a system for controlling the operation of the furnace are described. Pelletized wood stored in a hopper is fed into the combustion chamber of the furnace from an elevated position; and combustion of the pelletized wood is controlled by microprocessor-based circuit which receives input signals representative of the interior and exterior temperatures of the building, the air flow and the level of fuel in the combustion chamber and processes this information in accordance with a predetermined program to switch the furnace into one of two modes. In the 'low' mode, the exterior temperature is below a certain value for example, 0° C., but the interior temperature is above it. In this case a fire is maintained in the combustion chamber in anticipation of the interior temperature falling beneath this value. If it does fall beneath this value the fan is switched to a 'high' mode and to promote vigorous combustion so that the heat output is sufficient to warm the building. A novel method of manufacturing a heat exchange element for use in the furnace is also described.

16 Claims, 11 Drawing Figures

SOLID FUEL FURNACE

The present invention relates to solid fuel furnaces, and to a system for controlling the ignition of the combustion chamber.

Solid fuel furnaces are well known in the art and use solid fuel such as coal, wood, sawdust and hogfuel. However, with such fuels, control of the rate of combustion or "burning" is difficult and consequently more fuel is often consumed than intended leading to inefficiency and wastage of energy. With sawdust, there can also be a safety problem, in that there is a risk of spontaneous combustion and explosions. This indicates the difficulty of safely controlling combustion of this fuel. A disadvantage with solid fuel heaters is that they require a fire to be maintained even when there is no need for heat. If the fire is allowed to burn out there is an unacceptable delay in re-establishing the fire to produce heat. A limitation of such conventional solid fuel furnaces is in the stoking of the combustion chamber; coal and sawdust can be stoked automatically by delivery to the bottom of the combustion chamber. Air then enters the chamber by an updraft to promote combustion of these fuels. When the furnace is in a standby condition it has been found difficult to regulate the updraft with the result that the control of combustion is inefficient and thus leads to wastage of fuel. With wood, stoking must be done by hand, this means that the level of fuel in the furnace must be regularly monitored by the user. This is inconvenient and means that the user cannot leave the furnace unattended for long periods. Moreover, the fresh fuel in the combustion chamber is positioned in the path of the flame front so that even at standby the fuel is consumed more rapidly than is desirable.

Furthermore, with the conventional heat exchangers used in solid fuel furnaces each heat exchange element is manufactured by positioning two identical curved sheets of metal opposite each other and welding them together to form, in cross-section, an oval with pointed ends. This method requires that the opposite sheets be carefully aligned and then the contacting edges welded together to form the heat exchanger. This method is time consuming and expensive. In addition, if there is any misalignment between the opposed edges, gaps can appear in the welds. These gaps can result in leakage of the combustion gas which mixes with the recirculating air. Of course, this is dangerous particularly in a domestic environment where the recirculating air is breathed. Other known types of heat exchanger elements are simple cylindrical pipes. However, these pipes have a low surface area to volume ratio this means that for a given amount of heat flowing through the tube there is less heat transfer to the surface area of the pipe than there would be with an alternative shape.

Objects of the present invention are to obviate or to mitigate the aforesaid disadvantages.

According to a first aspect of the present invention there is provided a solid fuel furnace for heating a recirculating heat medium, the furnace having a fuel holder to hold fuel and allow combustion thereof, fuel delivery means arranged to deliver fuel to the fuel holder from an elevated location, so as to be supported by the fuel, air supply means for delivering combustion air to the fuel past the delivered fuel, and a combustion product duct to receive combustion products from the fuel holder, the duct including a heat exchanger to transfer heat associated with the combustion process to the heating medium circulating through said heat exchanger.

According to a second aspect of the present invention there is provided a method of supplying heat to an environment using a solid fuel surface furnace said method comprising, providing a supply of pelletised wood, combining the supply of pelletised wood with an air supply, forming, in a fuel holder, an ignitable mixture comprising the pelletised wood and the air of the air supply, igniting fuel in the fuel holder whereby said fuel burns, sensing the rate of burning of said fuel, using the said rate of burning to control the delivery of fuel to the fuel holder, exchanging heat associated with the combustion of the fuel with the recirculating heating medium, said recirculating heating medium being used to supply air to the environment, using the temperature of the environment heated by the recirculated air to control ignition of the fuel in the fuel holder.

According to a third aspect of the present invention there is provided a system for controlling the combustion of fuel in a fuel holder of a combustion chamber of a solid fuel furnace, the output of which is used to heat a heating medium which is recirculated to heat a building, the system comprising interior and exterior temperature sensors responsive to temperature within and outside the building, fuel level sensing means responsive to the level of fuel in the fuel holder, air flow sensing means responsive to air flow in the combustion chamber, means for sensing the ignition of fuel in the combustion chamber, fuel feed means adapted to feed fuel to the combustion chamber, ignition means adapted to ignite the fuel in the combustion chamber, and heat medium recirculating means adapted to circulate heat throughout the building, data processing control means connected to each of the sensing means on which form the inputs thereof, said data processing control means having outputs connected to the fuel feeding means to the ignition means and to the heat medium recirculating means whereby said data processing control means is programmable to provide a variety of output control signals in response to a predetermined set of sensor output signals, said data processing output signals being adapted to energise the fuel feeding means, the ignition means and the recirculating heating medium whereby the combustion of fuel in the fuel holder of the combustion chamber is controlled such that a low level combustion occurs when the interior temperature is less than the value set by the user but more than the exterior temperature set to a predetermined reference, the fuel in the fuel holder of the combustion chamber exceeds a predetermined level and the air flow in the combustion chamber is sufficient to support efficient combustion, and a high level of combustion occurs when the interior temperature falls beneath a predetermined value, fuel and air being supplied to the combustion chamber to support said high level of combustion at a level such that the heat reciculated is sufficient to heat the building.

According to a fourth aspect of the present invention there is provided a system for controlling the combustion of fuel in a combustion chamber for a solid fuel furnace, the output of which is used to heat a heating medium which is recirculated to heat a building, the system comprising first and second temperature means responsive to the interior and exterior temperatures of the building respectively, means for comparing the interior and exterior temperatures with predetermined values, said system being arranged to interrogate the outside temperature and the inside temperature in a predetermined sequence, whereby when said outside temperature falls beneath a first predetermined value, said inside temperature is interrogated and depending on the value of said inside temperature, said system actuates the furnace to operate in a first heating mode whereby the system is primed to anticipate a further change in temperature such that heat can be supplied to the building via said heat medium recirculating means almost instantaneously.

According to a fifth aspect of the present invention there is provided a control circuit for controlling the operation of a solid fuel furnace comprising a plurality of input sensors connected to inputs of a data processing and control unit, a plurality of output devices connected to the output of said data processing and control units, said data processing control unit being programmable whereby for a given set of sensor input signals, predetermined output control signals are supplied by said data processing control unit whereby the operation of said solid fuel furnace is controlled such that it switches into a first mode in anticipation of the interior temperature falling beneath a predetermined value and operates in a second mode when said interior temperature falls beneath said predetermined value, said first mode and said second mode being adapted to deliver substantially different quantities of heat to said building.

According to a sixth aspect of the present invention there is provided a method of manufacturing a heat exchange element, said method comprising, providing a generally planar sheet adapted to be formed into a heat exchange element, deforming the sheet so that said sheet is curved in one direction, folding said curved sheet substantially about the middle of said curve by applying a force to the concave centre of said curve whereby the extremeties of the sheet become opposed, and joining the opposed extremities of said sheet to form a heat exchange element, said heat exchange element being substantially ovoid in cross-section.

Preferably the opposed extremities are joined by any suitable process which provides a continuous airtight seal along the length of the element.

According to a seventh aspect of the present invention there is provided a heat exchange element of generally ovoid cross-section, said heating element being hollow and having walls of substantially uniform thickness, one fold of the ovoid being integral with the walls and forming a continuous airtight seal, the other fold being defined by coacting ends of the walls and being sealed by sealing means to provide a substantially airtight seal along the length of the element.

Embodiments of these and other aspects of the present invention will now be given by way of example with reference to the accompanying drawings in which.

Figure 1:
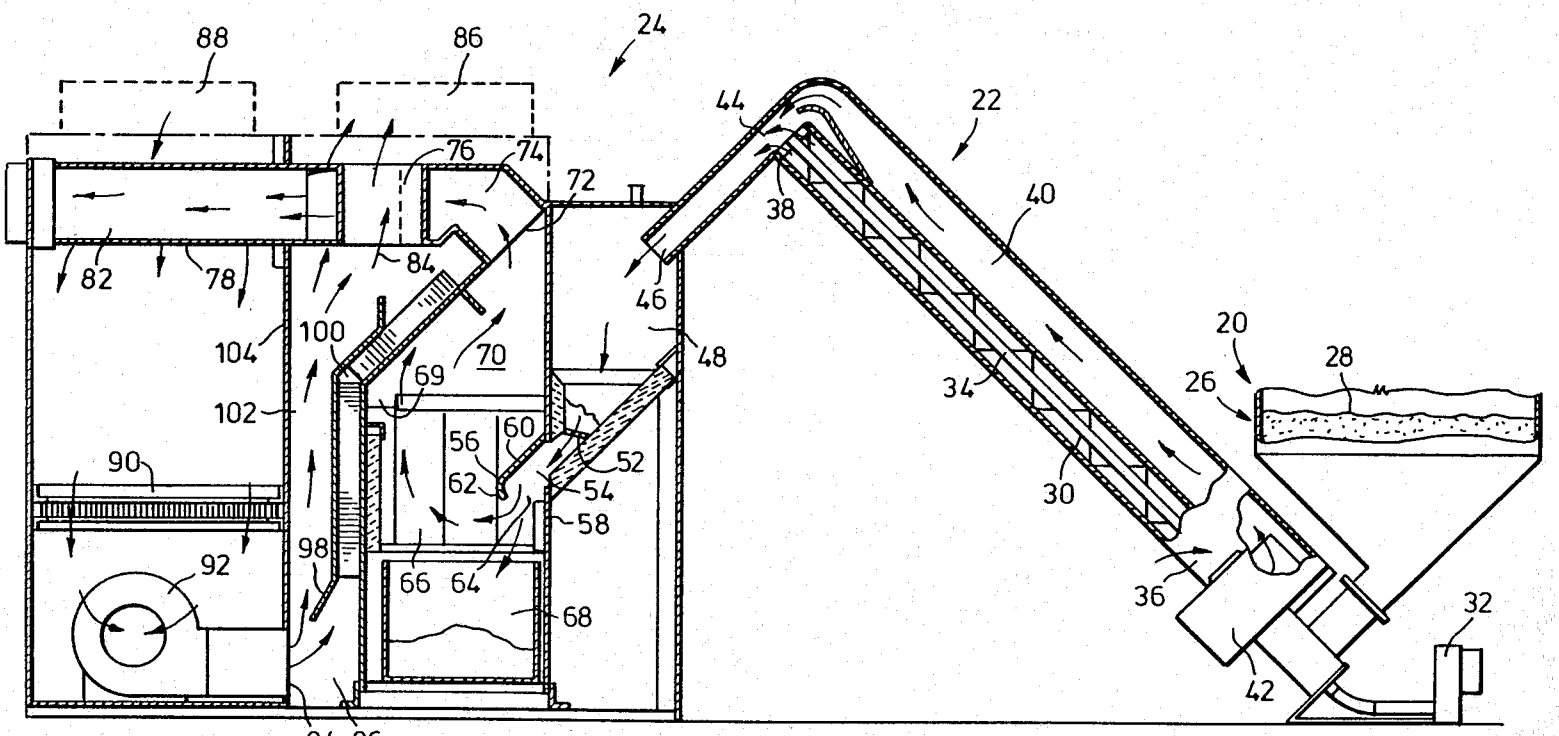
FIG. 1 is a schematic diagram of a solid fuel furnace and means for supplying fuel to said furnace.
Figure 2:
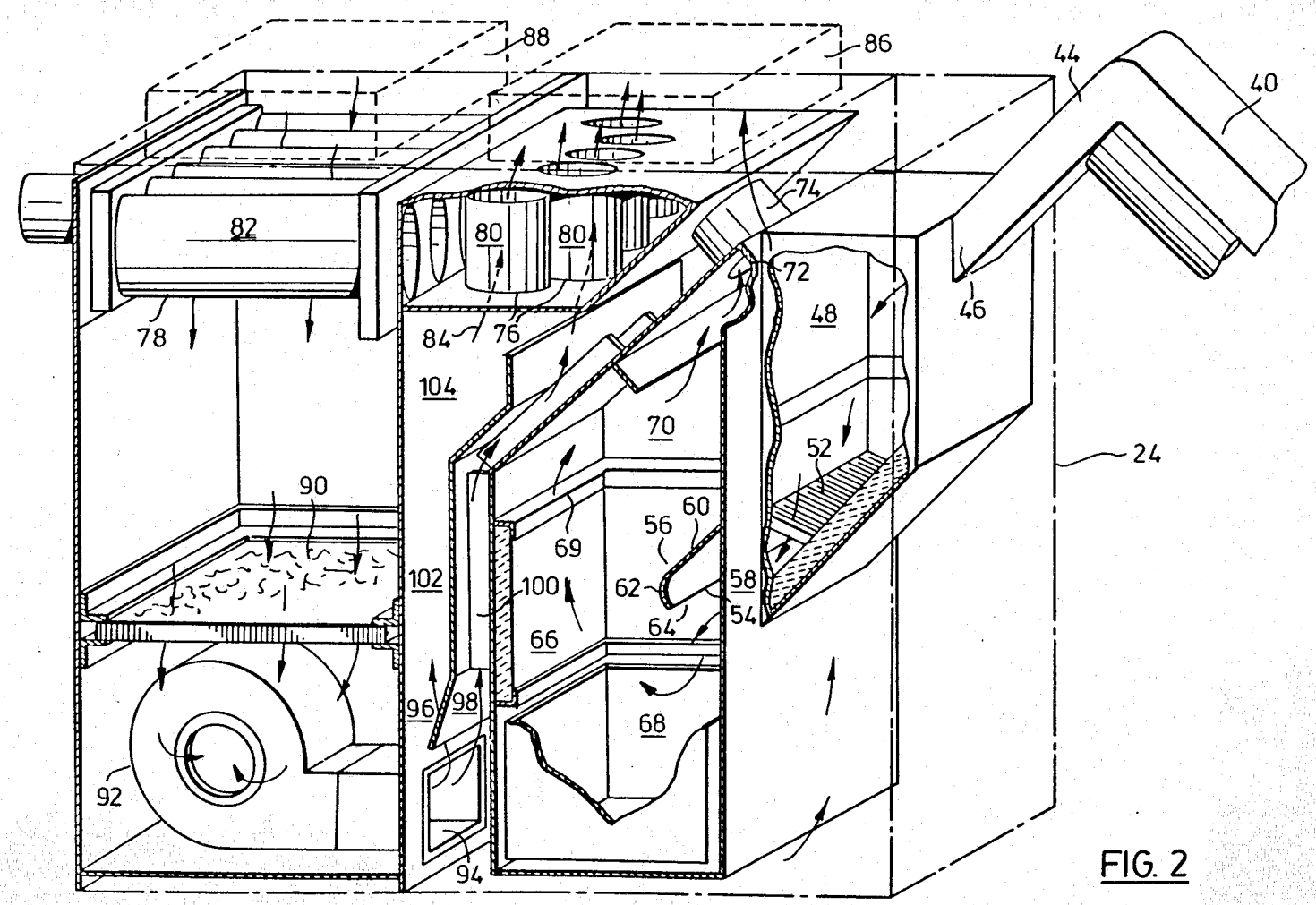
FIG. 2 is an enlarged and more detailed partial cutaway view of the furnace of FIG. 1.

Referring now to FIG. 1 of the drawings, a fuel store 20 is connected by a fuel supplier 22 to a solid fuel furnace 24. The fuel store comprises a hopper 26 which contains a supply of pelletised wood 28. The pelletised wood being commonly known under the trade marks such as WOODEX TM or Energex TM for example. Pelletised wood is transported by an auger 30 which is driven by an auger drive motor 32. The auger 30 has a generally helical flight 34 rotatable within a housing 35 and when driven causes the pelletised wood 28 to be transported along the housing 35 from the lower end 36 of the auger 30 to its upper end 38. The fuel supplier 22 also has an air supply duct 40 which is parallel with the auger 30 and which is supplied with air from a blower 42. The air supply duct 40 and the upper end 38 of the auger 30 are combined in a throttle duct 44 which is of substantially narrower cross-section than the air supply duct 40. The outlet 46 of throttle duct 44 guides pelletised wood 28 into a combustion chamber 48 associated with the furnace 24. The combustion chamber 48 is located beneath the outlet 46 of the throttle duct 44. The combustion chamber 48 tapers towards a grate 52 on which the pelletised wood 28 lies, once delivered from the throttle duct outlet 46.

The underside of the grate 52 leads into a channel 54 which is defined by a baffle 56 and a wall 58 of the combustion chamber. The baffle has a first generally inclined portion 60 which is substantially parallel to the wall 58 and a second vertically downwardly extending portion 62 connected to the first portion 60. At the lower end of the channel 54 there is an opening 64 through which combustion products pass leading into a combustion products chamber 66. At the lower end 68 of the chamber 66 is a pit 68 which connects ash and other non-gaseous combustion products. The chamber 66 has an upper opening 69 which leads into an upwardly tapering chamber 70. This tapering chamber 70 has an upper exit 72 which leads into a vent duct 74 for venting the combustion gases to the exterior of the building. The vent duct 74 has two heat exchange units 76, 78 located therein. The units 76, 78 are composed of a plurality of heat exchange elements. The elements 80 of the heat exchange unit 76 are perpendicular to the general direction of vent duct 74. The duct 74 and the elements 82 are parallel to the duct direction. The elements 80 of heat exchange unit 76 receive air recirculating air 84 which is heated therein by combustion gases and which passes through supply ducting 86 into the environment to be heated. The environment air returns through return ducting 88 and contacts outside of the heat exchange elements 82 of heat exchange unit 78 where the recirculated air is preheated. This recirculated air is drawn through a filter 90 by a fan blower 92 which blows air through an opening 94 into a bifurcated duct 96. The bifurcated duct 96 includes a baffle 98 which directs a proportion of the air therein through a set of fins 100 which follow the wall contour of the combustion products chamber 66 and the tapering chamber 70. The remaining air passes through a duct 102 on the outside of the fins 100. The air from the set of fins 100 and the duct 102 is combined in an upper region 104 prior to passing through the interior of heat exchange elements 80.

During combustion the combustion gases pass through channel 54 and enter combustion gas chamber 66 and are directed therein by the baffle 56 which provide a centrifugal forces and separates the gases from the particulate matter which then falls as ash into an ash pit 68. The combustion gases pass through the combustion gas chamber 66 and exit through the opening 66, and pass through the tapering chamber 70 and through to exit 69, to heat exchangers 76 and 78 to the external vent duct 74. Recirculating air is blown by the fan blower 92 into the bifurcated duct 96 some air being deflected by the baffle 98 which deflects half the air flow through the set of fins 100 the other air passing through the duct 102 and the surrounding of the combustion chamber. The set of fins contain fin elements 106 which conduct heat from the combustion gas chamber 66. The cross-section of the fins 100 is relatively narrow in comparison to duct 102 and causes an increased velocity of air therethrough. This increased velocity of air increases the heat conduction from the gas chamber 66 to the recirculating air. The air from ducts 100 and 102 merge at region 104 and pass through the interior of the heat exchangers 80 and from there into the supply ducting 86 of the heating system. Air collected from the environment is returned through return ducts 88 and passes through a heat exchanger 78 on the outside of elements 82. The air then passes through the filter 90 where it is returned to the blower 92 for recirculation through the furnace 24.

It should be understood why the hot air from ducts 100 and 102 pass through the interior of the heat exchanger; this is because the configuration of heat exchange elements 80 maximizes heat transfer by the heat exchanger 76. The air returning, that is, via return ducting 88 passes over the outside of the heat exchange elements 82. This air is at a lower temperature and this configuration of elements maximizes the heat transfer of this particular heat exchange unit. These configurations helps to maximize the efficiency of the heating system.

The operation of the furnace controller will now be described as follows with reference to the block diagram of FIG. 5 and the circuit diagram of FIG. 6.

Figure 5:
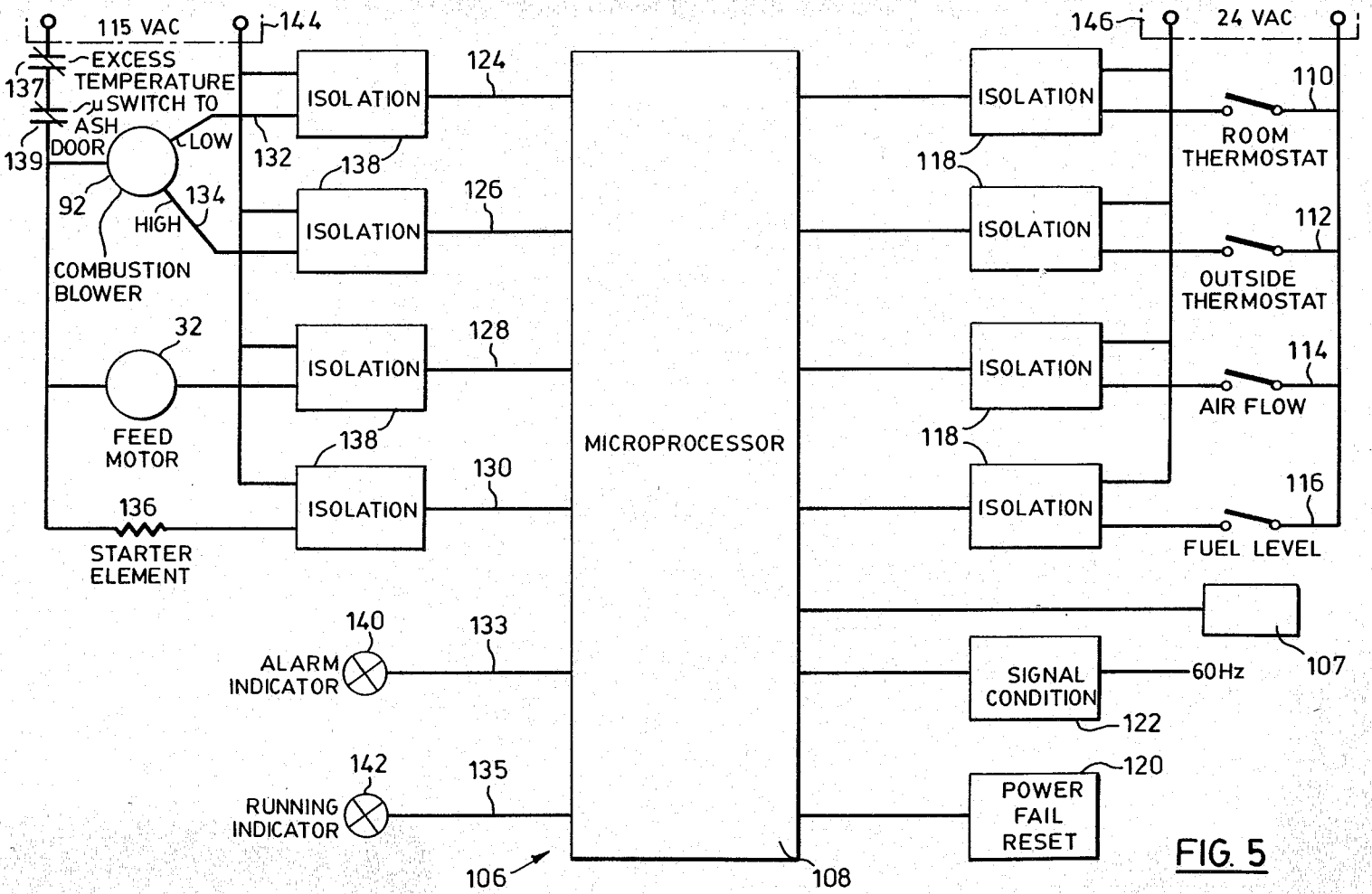
FIG. 5 is a block diagram of a control circuit for use with the furnace of FIGS. 1–4.

Referring now to FIG. 5 of the drawings a controller, indicated by reference numeral 106, has a microprocessor 108 to receive sensor signals and to provide output signals in accordance with its program, the sensor signals being generated by microprocessor 108 is connected to a room thermostat 110, an outside thermostat 112, an infra-red flame sensor 107, an air flow sensor 114 and the fuel level sensor 116 via isolators 118. The microprocessor 108 is also connected to a power circuit 120 and to a signal conditioning circuit 122. The microprocessor has outputs 124, 126, 128 and 130 which are connected respectively to the high and the low positions 132, 134 of the fan blower 92, to the auger feed motor 32, and to the ignition element or starter element 136 via isolators 138. Outputs 133, 135 are also connected to an alarm indicator 140 and a running indicator 142 which indicate whether or not the system is running satisfactorily. The alarm indicator is a light emitting diode as shown in more detail in FIG. 6. An excess temperature relay 137 and a switch 139 to the ash door in the secondary combustion chamber are powered by 115 v a.c. in the supply to the combustion blower 92, feed motor 32 and ignition element 136.

Figure 6A:
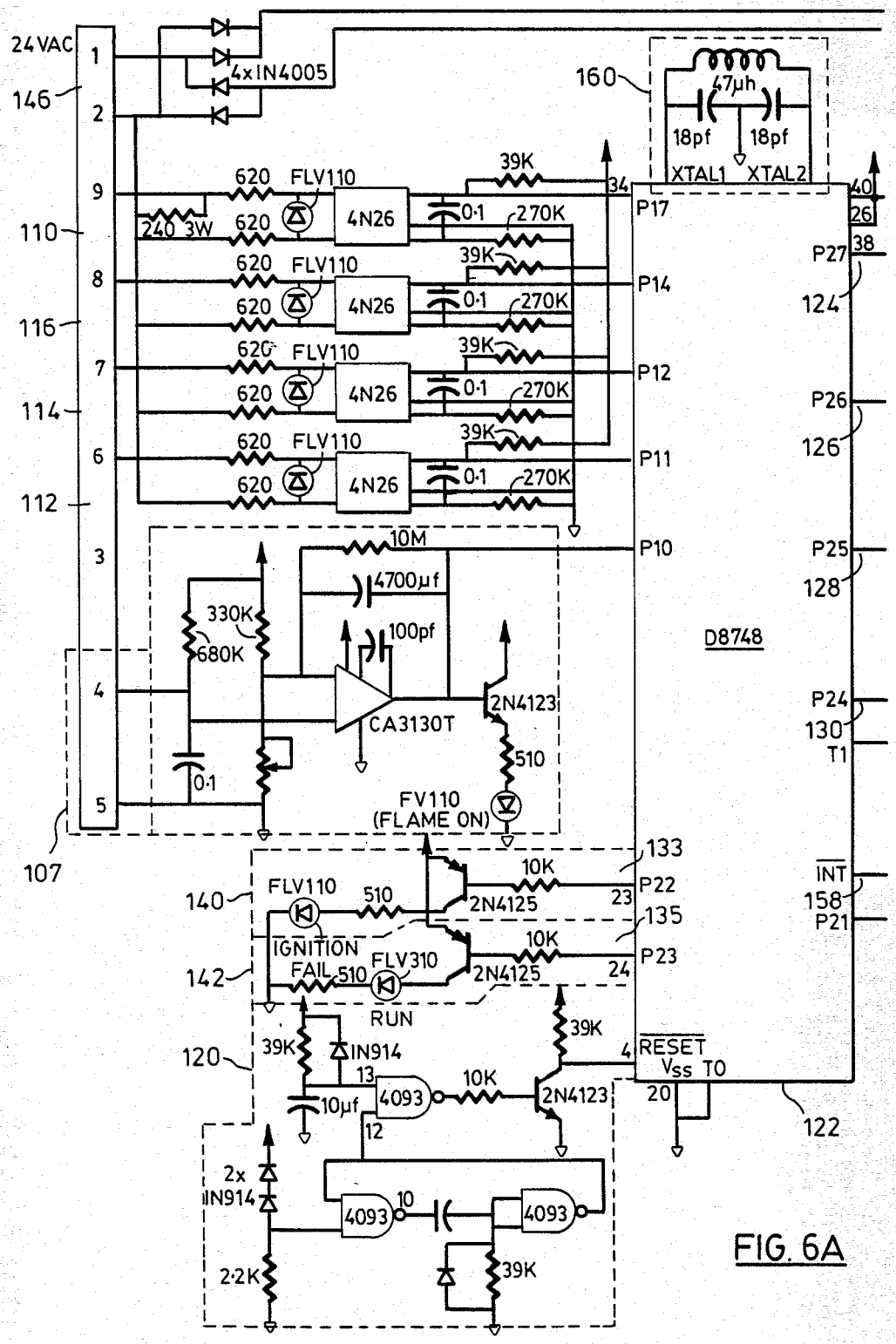
FIG. 6 is a detailed circuit diagram of the block diagram of FIG. 5.
Figure 6B:
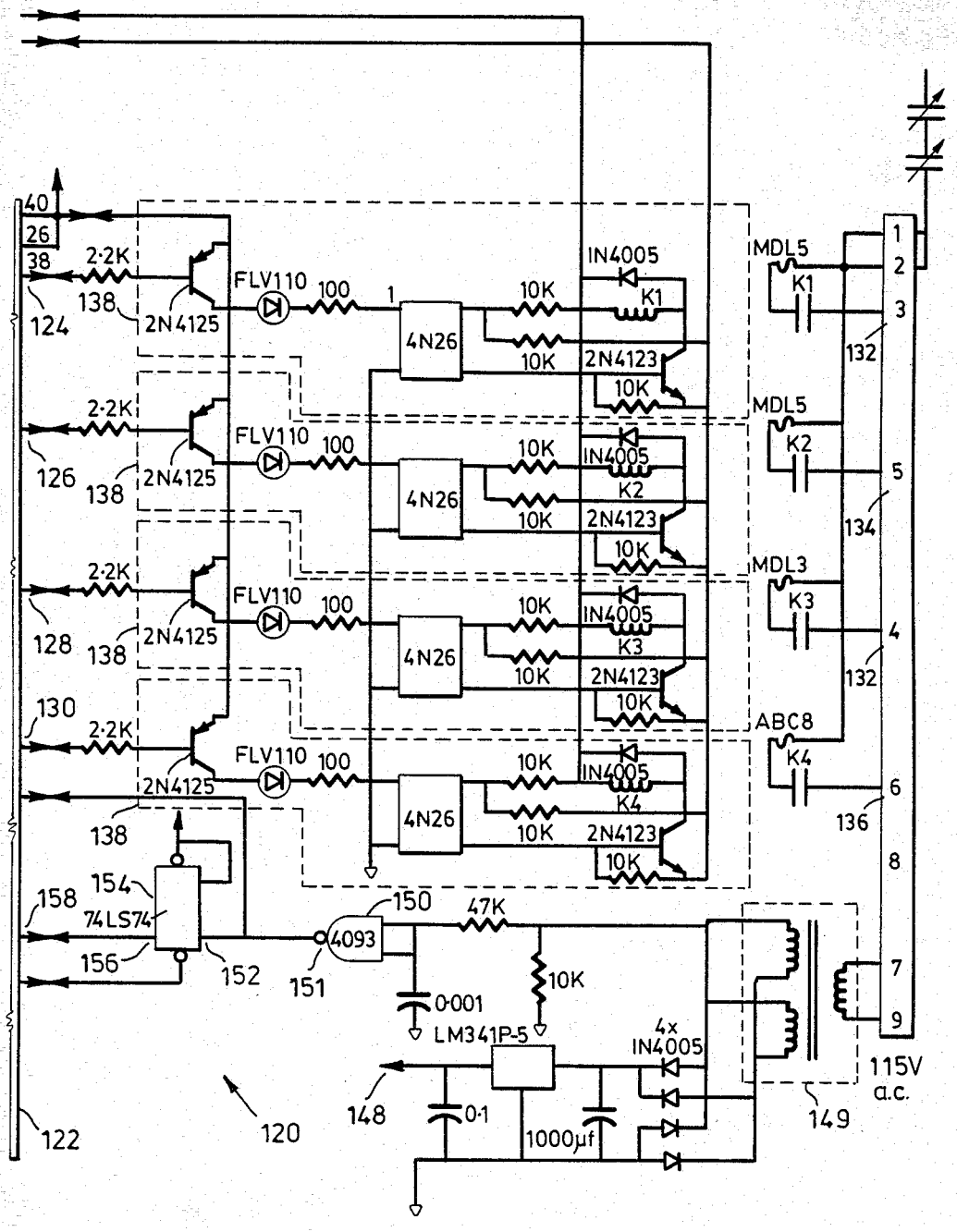

Referring now to FIG. 6 the combustion blower, feed motor and starter element are all powered by a 115 volts a.c. supply 144 and the sensors 110, 112, 114 and 116 and microprocessor output circuitry are powered by the 24 volt a.c. supply 146. Signals from 110, 112, 114 and 116 which are either contact or no contact, i.e. 24 volts a.c. or 0 volts; go into isolators 118 which are powered by 6.3 volts d.c. from 148. The flame sensor 107, is a lead sulfide, infrared detector, the resistance of which decreases with increase in the infrared radiation intensity of the source to be detected. The isolator circuit 161 for the flame sensor detects the change in sensor resistance. The 1 Megohm trimpot is set for switching at 640K sensor resistance. Hysterisis in this configuration is approximately 35K. Flame is deemed to be out when sensor resistance is 660K or above, or when resistance is 625K. Turning trimpot counter clockwise reduces trimpot resistance thus increases sensitivity of the circuit. Turning the trimpot clockwise the sensitivity is decreased. Each of the input sensor circuits and each of the output control circuits includes a light emitting diode, type FLV110, which will indicate the operational status of that particular circuit.

The 115 volts a.c. supply is passed t-hrough the step-down transformer 149 to 6.3 V. a.c. and half wave-rectified and is then gated through a NAND gate 150 which in this configuration acts as an inverter then feeds a series of square wave pulses at a frequency of 60 Hertz to the clock input 152 of a flip flop 154. The Q output 156 of the flip flop 254 is connected to an interrupt input 158 in the microprocessor 122 and the flip flop itself is resettable from pin 21 on the microprocessor 122. The output 151 from the NAND gate is also connected to the timer input 39 on the microprocessor chip. Pins 2 and 3 in the microprocessor are allocated to the external crystal 160.

Figure 7:
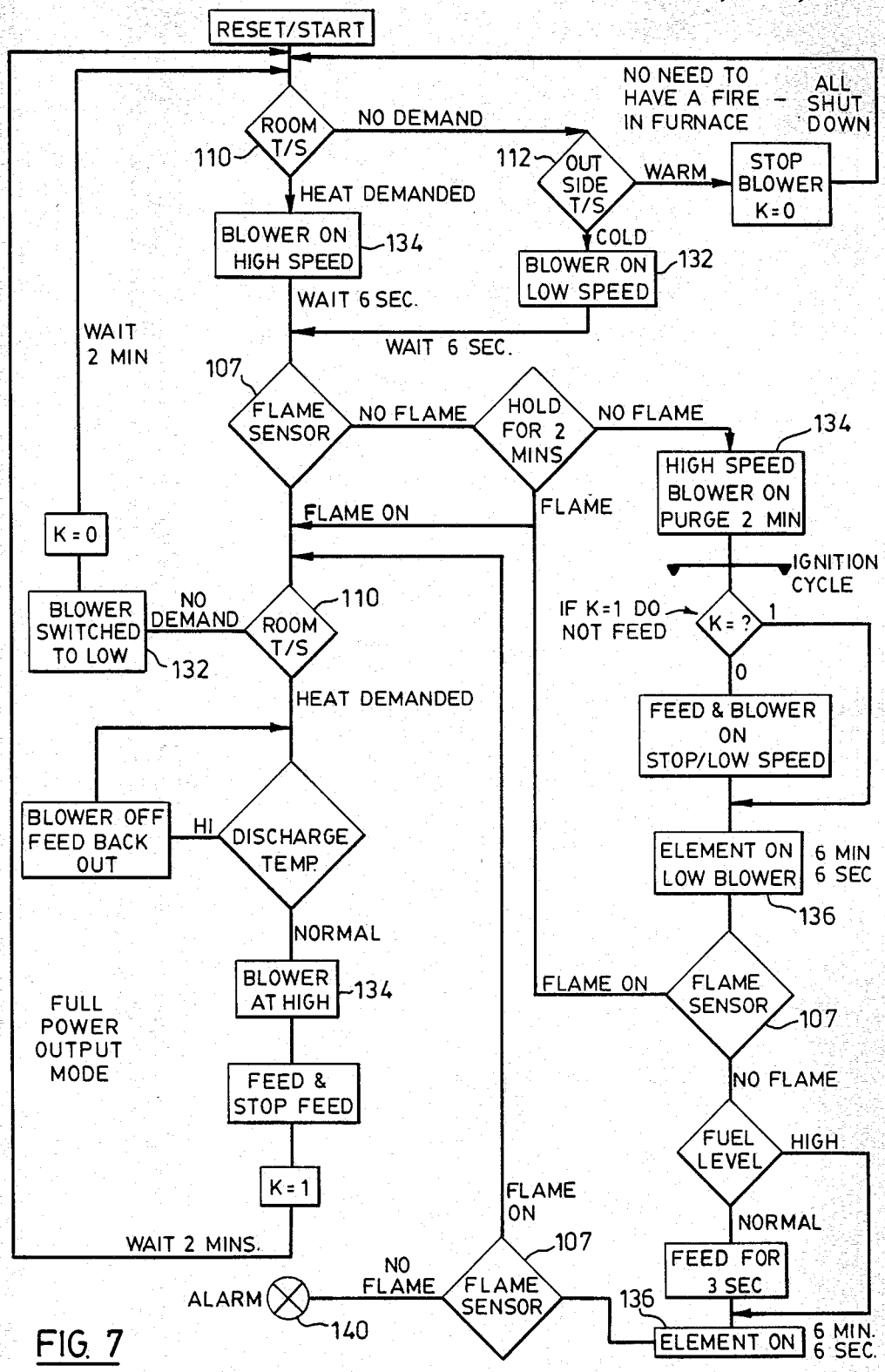
FIG. 7 is a flow chart of events which control the operation of the ignition system and supply of heat from the furnace of FIGS. 1–4, in accordance with the circuits of FIG. 5 and FIG. 6.
Figure 11:
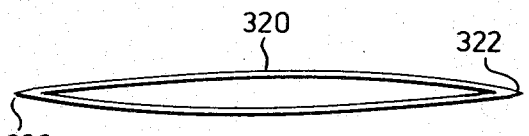
FIGS. 8, 9, 10 and 11 illustrate the steps in the manufacture of a heat exchange element utilised in the furnace shown in FIGS. 1–4.
Figure 10:
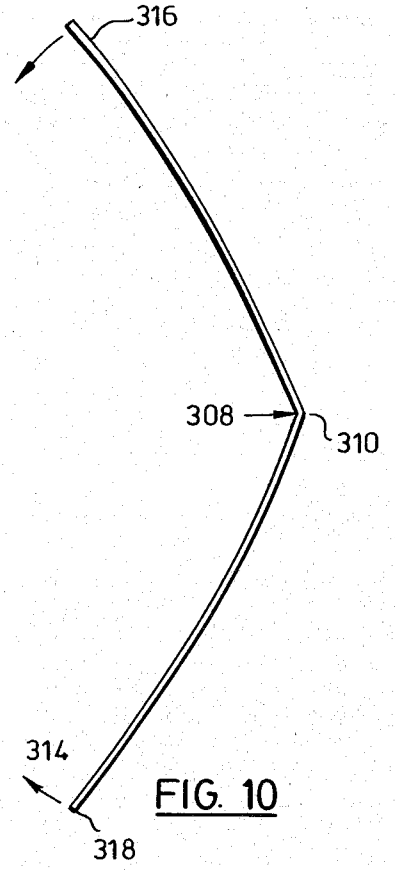

The various interconnections of a system component and their operation will now be explained in more detail with reference to FIG. 5 and FIG. 6, and especially to FIG. 7 which is a flow chart of the events which control the operation of the ignition system and the supply of heat from the furnace.

To facilitate description of operation of the furnace, an initial set of conditions is assumed, in which the fuel in the combustion chamber 48 is depleted and the outside temperature of the building is falling. The critical temperature for the outside is T1 and the critical temperature for the inside is T2 i.e.; these are the temperatures which effectively control the operation of the furnace.

When power is switched on the room thermostat sensor 110 checks if the room temperature is equal to T2 or lower. In the case where the temperature is above T2 it then checks with the outside thermostat 112. If the outside thermostat 112 temperature is greater than T2, a signal is sent to stop the fan blower 92. This means that there is no need to have a fire in the furnace 24 and the furnace 24 remains off. Should the outside temperature falls below T2 a signal is sent to the fan blower 92 which switches the blower 92 onto low speed 132. The flame sensor 107 which is located in the top plate of the combustion chamber 48 then checks if there is a flame in the combustion chamber 48 and, in this case, as there is no flame it waits for one (1) minute and if still no flame actuates the blower 92 to switch to high speed 134 for a period of one (1) minute. However, if after two minutes there is a flame the blower is switched onto low speed. The high speed blowing clears unburnt gases and ashes from the combustion chamber. After a predetermined period of two minutes the control circuit then senses, via a timing circuit within the microprocessor 122, the history of fuel feeding. That is, if the timing circuit provides a logic '1' signal this indicates that a fuel 'feed' has recently occurred, for example, within the last two minutes. Conversely, logic zero indicates that there has been no feeding within that same period. Assuming that the combustion chamber 48 has used up the fuel then a logic zero received. This signal actuates the auger drive 32 to supply pelletised wood 28 via the auger 30 to the combustion chamber 48. It also switches the fan blower 92 onto low speed and simultaneously ignites an ignition element 136 which then remains ignited for a period of 6 minutes and 6 seconds. The flame sensor 107 is then again interrogated to see whether the ignition has produced a flame. In the situation where there is no flame sensed the fuel level is then assessed. As there is no fuel there will be no flame and this actuates the feeder to produce fuel for three seconds. The element 136 is again switched on for a period of six minutes and six seconds and the flame sensor is again interrogated. Should there still be no flame after two attempts to light up the furnace 24 is shut down and an alarm 140 in the form of a flashing light (not shown) will indicate a warning. In the situation where the furnace 24 is ignited and a flame produced, the logic unit then interrogates the room thermostat 110 to see whether the room temperature has fallen below T2. If the room temperature is above T2 the fan blower 92 is switched to low speed. This is analogous to the pilot light in a gas furnace. This low speed provides air which is just sufficient to keep the pelletised wood 28 ignited so that, if and when the interior temperature falls beneath T2, there is provision for almost instantaneous heat delivery. Assuming now that the interior temperature falls below T2, the room thermostat 110 senses this temperature and sends a signal to the microprocessor 122 which actuates the blower 92 to switch to high speed 134. The flame sensor 107 then indicates that there is a flame in the combustion chamber since the fuel has been ignited previously when the blower was switched to low speed and the room thermostat 110 gives a demand signal to the microprocessor 122. The recirculating fan blower 92 is then switched on to high speed 134 and the hot combustion air is conducted via the heat exchange units 76, 78 to the recirculating heat medium. This is the normal power output mode of the furnace 24. Should the temperature of the heat exchanger 76 become too high for some reason then a signal is sent from a thermostat (not shown) and the heat exchanger, which shuts off the fan blower 92 and which prevents more fuel being fed via the auger 20. Therefore, only the fuel present in the combustion chamber 48 is used up. The level of pelletised wood 28 in the combustion chamber 48 is monitored by the fuel level detector 116 in the combustion chamber 48. If a high fuel level is reached a lockout feeding arrangement prevents further fuel being fed into the combustion chamber. A similar situation arises when air flow is not detected, an air flow detector also locks out, via the microprocessor 122 firmware, the ignition element 136, otherwise the fuel would burn with very low air which would be very inefficient.

Figure 3:
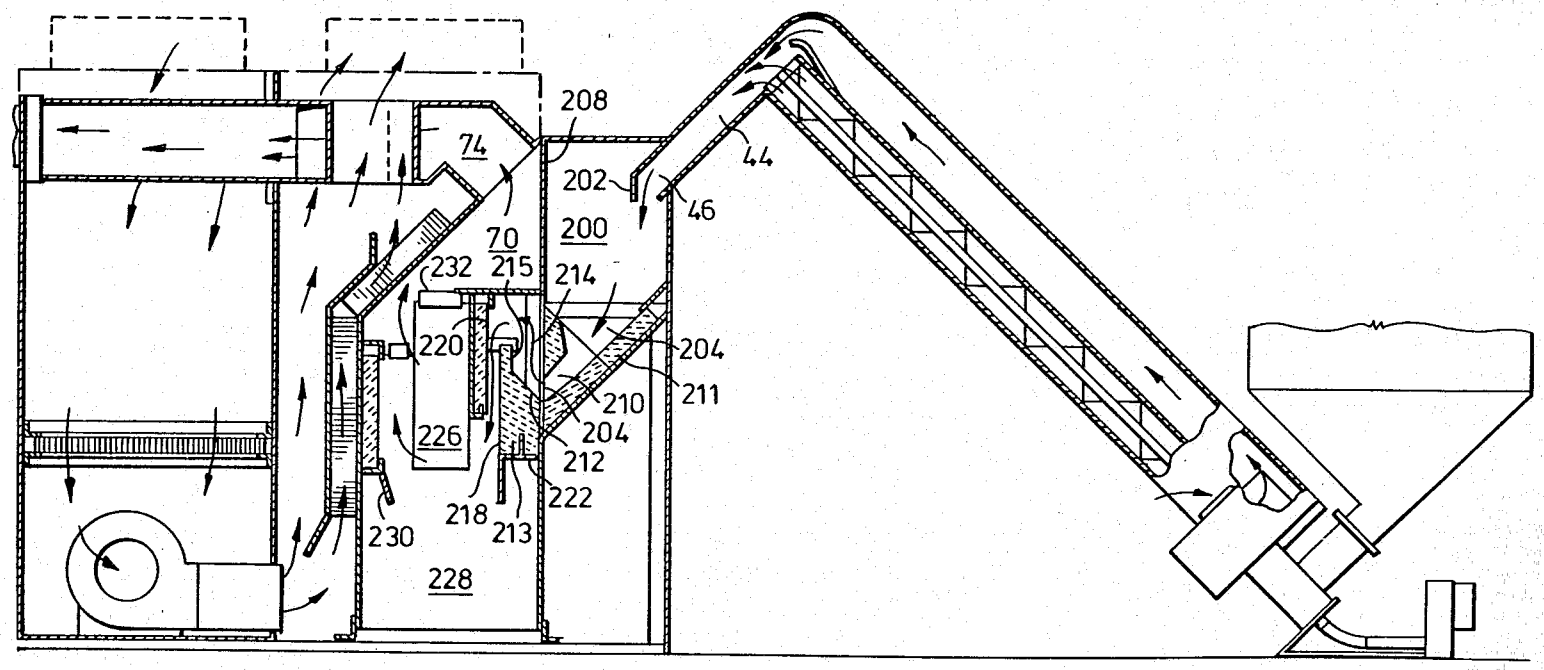
FIG. 3 is a similar view to FIG. 1 but shows an alternative arrangement of combustion chamber.
Figure 4:
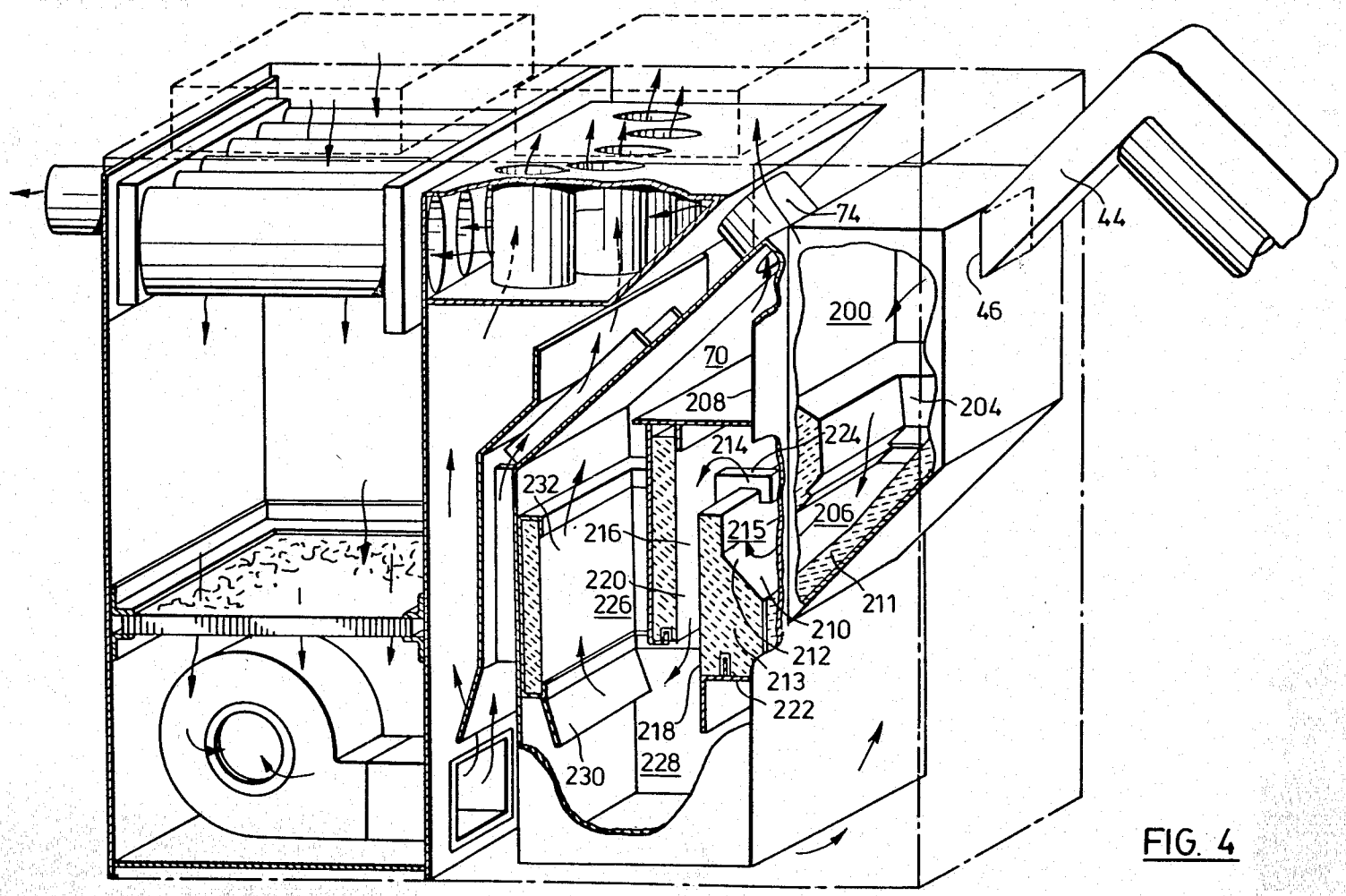
FIG. 4 is a view similar to FIG. 2 but shows an alternative arrangement of combustion chamber.

An alternative embodiment is illustrated in FIG. 3. This embodiment is the same as that described with reference to FIGS. 1, 2 and FIGS. 4 to 6 except for the combustion chamber and the ash separation of secondary combustion chamber. The outlet 46 with throttle duct 44 guides pelletised wood into a primary combustion chamber 200. The throttle duct has a baffle 202 over its outlet to augment and direct the flow of air into the primary combustion chamber. The chamber 200 descends into a tapering chamber 204 which tapers towards an opening 206. The walls of the tapering chamber 204 are lined with a refractory material. The opening 206 descends and passes through a wall 208 of the combustion chamber 200. A generally V-shaped channel 210 forms a fuel holder and this fuel holder is defined by the refractory material 211 on the tapering chamber 204 and by a sloping surface 212 of refractory material 213, the sloping surface being at an angle of 45° to the vertical. The sloping surface 212 terminates in a generally vertical section 215 of refractory material defining a particle suspension chamber 214 therein. The angle between the section 215 of sloping surface 212 is in fact about 135° for reasons which will be described later. The particle suspension chamber 214 leads into a narrow, vertical passage 216 which is defined by the vertical surfaces 218 and 220 of two pieces of refractory material. The refractory material 210 is mounted on a steel shelf 222 and a high temperature ceramic spacers 224 is positioned between material 210 and the surface 218 at each end of the V-shaped channels 210 to prevent the shelf 222 tilting due to the weight of the material 213 when hot and thus blocking the passage 216 to the air flow.

The passage 216 terminates in an expansion chamber 226 below which is a secondary combustion chamber 228 which contains an ash pan (not shown). A baffle 230 is included in one side of the secondary combustion chamber 228 to direct the falling ash. The expansion chamber 226 has an upper opening 232 which leads to an upwardly tapering chamber 70 which in turn is connected to vent duct 74 already described for venting the combustion gases to the exterior of the building.

In use, pelletised fuel 28 enters a primary combustion chamber 200 and is directed into the V-shaped fuel holder 210 and forms a mound of fuel therein. Air is blown through and over the mound of fuel and the combustion gas is swept into the combustion chamber together with particles of burning pelletised fuel. The angle between the slope and the vertical surface has been found to be important to determine the particle size of the suspension, in fact within the suspension chamber there is a suspension of particles, the size of the particles in suspension depending on the angle between the sloping surface 212 and the surface 215. Typically for an angle of 135° the suspended particles about the 500 microns although as already mentioned this depends on the angle between the surfaces. As the suspended particles burn they radiate heat energy and when they burn down to a predetermined size they are swept by the air supply through the suspension chamber and down the narrow passage 216. This accelerates the air and particle flow and into an expansion chamber 226 which acts as a brake to the fast flowing air stream slowing the flow down such that nearly all the still burning fuel particles separate from the air. The heated air rises in the expansion chamber through the opening 232 into the vent duct 74 and passes through the heat exchanger elements before being vented to the exterior of the building. The particles deposited as refuse continue to burn, radiating heat energy which rises to combine with the already heated air, the heated air combination flowing through the heat exchanger. The secondary combustion chamber has a door by which the ash pan may be removed and emptied. A micro switch is provided on the door (not shown) of the secondary combustion chamber so that when the door opens power to the blower and feed motor is disconnected. In this embodiment the infra-red flame sensor 234 is mounted on an access plate to the primary combustion chamber.

Without departing from the scope of the invention it should be appreciated that various modifications may be made to the apparatus and method of operation as described above. For example, the supply of pelletised wood 28 could be located above the combustion chamber 48 and could be fed by gravity or by some other means. The layout of the block diagram of FIG. 5 and the circuit diagram of FIG. 6 are exemplary only as are the type and value of the components selected and should not be construed as limiting the principle of operation of the control circuitry in any way.

Figure 9:
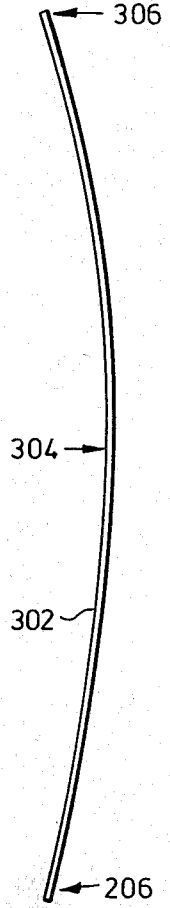
Figure 8:
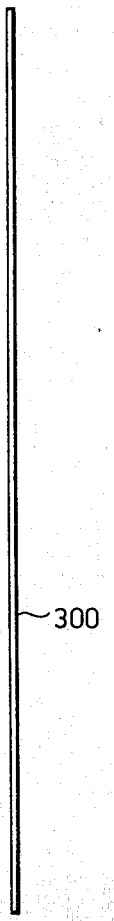

Referring now to FIGS. 8, 9, 10 and 11 a sheet of metal 300 of predetermined dimensions (FIG. 8) is deformed using a pyramid or other type of roller to provide a curved sheet 302 (FIG. 9). This deformation may be achieved by a press or press brake, to the centre of a sheet 300 as shown causing it to 'bow' or flex. The curved sheet 302 is then folded by applying a force 308, in a press brake or press (not shown), at the centre 310 of the concave side of the sheet against a die such that the sheet 302 is folded about the punch or former to form an exaggerated ovoid shape 320 (FIG. 11) with generally tapered and pointed ends 322. The edges 316 and 318 are joined by welding to form a hermetic seal 326. It is important that this seam should be gas-tight to prevent mixing of the combustion gas with the recirculating gas of the air. It should also be understood that edges 316 and 318 may be joined by soldering or by using a thermosetting adhesive or tape. This method provides a simple and inexpensive way of manufacturing a heat exchange element, the heat exchange element facilitating the most efficient transfer of heat across its surface by virtue of its shape. A cylinder has minimum surface area for maximum cross-sectional area and the resistance to heat flow, which is proportional to the distance between the centre of the tube and inside surface area and the flow is too slow so that insufficient heat is transferred for a given mass of gas. In contrast the present cross-section limits the centre to wall distance for a given cross-sectional area and increases the velocity of the flue gases and thus the momentum transfer thus permitting a much greater heat transfer for a given mass of gas.

An advantage of this method of manufacture is that the integral end of the element 322 positions the opposite edges 316 and 318 opposite each other so that the end 324 can be easily welded in a straight line, which helps to ensure that the weld is continuous, strong and forms a hermetic seal.

One advantage of the present invention is that the temperature of the building interior is anticipated by using the exterior temperature as a reference. This permits the furnace to be 'primed' thereby facilitating instantaneous heat delivery. This contrasts with conventional solid fuel furnaces where there is a time lag between the furnace being started up and heat being delivered; The efficiency of a furnace is maximized by using ovoid heat transfer elements in a particular configuration such that the maximum heat is extracted from the combustion gases to be circulated through the building heating ducts and the returning air also extracts the maximum heat from the combustion gases with another heat element configuration; the control circuitry developed provides that the ignition state of the fuel is continuously monitored and the fuel is automatically stoked; the rate of burning of fuel is automatically adjusted to give a substantially constant supply of heat in accordance with the desired room temperature; the furnace utilises pelletised wood which is clean, easy to store and which provides a controllable medium for combustion; the control circuitry of the present invention also includes various safeguards to switch the furnace off in the event of excessive combustion or excessive heat exchange temperature being measured or if the air supply suddenly ceases; heat is supplied to an environment at a predetermined temperature with the minimum of interference or supervision by the user and the furnace utilises conventional materials in the construction of the furnace and auxiliary apparatus.

It will be appreciated that a solid fuel furnace and apparatus for controlling the operation of the furnace has been described with reference to specific aspects of its construction and operation which simplifies both the operation and maintenance as well as safety aspects of the furnace. Furthermore, the novel solid fuel furnace offers advantages in operation, particularly that it does not require maintenance and that it automatically is self-stoking with reference to convention solid fuel furnaces.

It will also be appreciated that other embodiments may be designed within the scope of the invention as claimed.

We claim:

1. A solid fuel furnace for heating a recirculating heat medium and comprising:

a combustion chamber having an inlet and an outlet, fuel support means located between the inlet and the outlet for supporting a supply of particulate fuel for combustion thereof, the combustion chamber inlet being located above the support means for receiving a supply of fuel and a supply of air to be delivered to the fuel support means from fuel delivery means and air supply means respectively, the combustion chamber being defined in part by walls which converge downwardly from the inlet towards the fuel support means, said convergement walls constituting means effective to throttle said air supply as it passs through or over said fuel, a combustion products suppension and separation chamber for separating heated combustion gases from combustion products, and for retaining said combustion products in suspension sufficiently long to permit continued combustion thereof, the combustion products suspension and separation chamber having an inlet connected to the outlet of the combustion chamber and an outlet for permitting the passage of heated combustion gases and incompletely combusted products therethrough;

heat exchange means having an inlet for receiving the heated combustion gases from the outlet of the combustion products and separation chamber, and said heat exchange means transferring heat from the combustion gases to the recirculating heat medium, the heat exchange means having an outlet for venting said combustion gases to atmosphere after transferring heat to the recirculating heat medium.

2. A solid fuel furnace as claimed in claim 1 wherein the air supply means and fuel delivery means are arranged so that the fuel being delivered is entrained in the air supply before being delivered onto the fuel support means.

3. A solid fuel furnace as claimed in claim 1 wherein the fuel support means is the base of a channel, the level of fuel in the channel defining an air path through or above the fuel and the air supply delivering combustion air through and over the fuel in the fuel holder to the outlet of the combustion chamber.

4. A solid fuel furnace as claimed in claim 1 wherein the fuel support means is a grate structure, the grate structure supporting said fuel such that the air supply delivers combustion air through the delivered fuel in the grate structure to the outlet of the combustion chamber.

5. A solid fuel furnace as claimed in claim 2 wherein the air supply means includes a conduit located in the region of fuel delivery to the combustion chamber, the conduit having a reduced cross-sectional area in said region to increase the velocity of air flowing through conduit prior to the entrainment of fuel.

6. A solid fuel as claimed in claim 1 wherein the fuel delivery means includes a mechanical conveyor for clevating fuel from a stored location to the combustion chamber inlet.

7. A solid fuel furnace as claimed in claim 1 wherein the combustion products suspension and separation chamber includes a surface sloping upwardly from the combustion chamber outlet and a surface upstanding therefrom, the angle between the upwardly sloping surface and the surface upstanding therefrom being substantially 135°.

8. A solid fuel furnace as claimed in claim 7 wherein the generally upstanding surface is vertical and the angle between the sloping surface and the vertical surface is 135°.

9. A solid fuel furnace as claimed in claim 1 including control means for controlling combustion of fuel in the combustion chamber, said control means being responsive to a plurality of remote signals to control said fuel combustion.

10. A solid fuel furnace for heating a recirculating heat medium and comprising:

a combustion chamber having an inlet and an outlet, fuel support means located between the inlet and the outlet for supporting a supply of particulate fuel for combustion thereof, the combustion chamber inlet being located above the support means for receiving a supply of fuel and a supply of air to be delivered to the fuel support means from fuel delivery means and air supply means respectively, the combustion chamber being defined in part by walls which converge downwardly from the inlet towards the fuel support means, said convergement walls constituting means effective to throttle said air supply as it passes through or over said fuel, a combustion products suspension and separation chamber for separating heated combustion gases from combustion products, and for retaining said combustion products in suspension sufficiently long to permit continued combustion thereof, the combustion products suspension and separation chamber having an inlet connected to the outlet of the combustion chamber and an outlet for permitting the passage of heated combustion gases and incompletely combusted products therethrough;

downwardly extending passage means having an inlet connected to the outlet of the combustion products suspension and separation chamber, and an outlet connected to a main expansion chamber, said passage means having a smaller cross-section in the direction of heated combustion gas from the said combustion products suspension and separation chamber, and said smaller cross-section constituting means effective to throttle and accelerate said heated combustion gases and incompletely combusted products into said main expansion chamber, said main expansion chamber being of substantially greater volume than said passage means to cause said heated combustion gases and incompletely combusted products to slow down sufficiently such that said incompletely combusted products are separated by gravity from said heated combustion gases, means for collecting said incompletely combusted products, heat exchange means having an inlet for receiving the heated combustion gases from the outlet of the main expansion chamber, and said heat exchange means transferring heat from the combustion gases to the recirculating heat medium, the heat exchange means having an outlet for venting said combustion gases to atmosphere after transferring heat to the recirculating heat medium.

11. A solid fuel furnace as claimed in claim 10 wherein the air supply means and fuel delivery means are arranged so that the fuel being delivered is entrained in the air supply before being delivered onto the fuel support means.

12. A solid fuel furnace as claimed in claim 10 wherein the fuel support means is the base of a channel, the level of fuel in the channel defining an air path through or above the fuel and the air supply delivering combustion air through and over the fuel in the fuel holder to the outlet of the combustion chamber.

13. A solid fuel furnace as claimed in claim 28 wherein the air supply means includes a conduit located in the region of fuel delivery to the combustion chamber, the conduit having a reduced cross-sectional area in said region to increase the velocity of air flowing through said conduit prior to the entrainment of fuel.

14. A solid fuel as claimed in claim 10 wherein the fuel delivery means includes a mechanical conveyor for elevating fuel from a stored location to the combustion chamber inlet.

15. A solid fuel furnace as claimed in claim 10 wherein the combustion products suspension and separation chamber includes a surface sloping upwardly from the combustion chamber outlet and a surface upstanding therefrom, the angle between the upwardly sloping surface and the surface upstanding therefrom being substantially 135°.

16. A solid fuel furnace as claimed in claim 10 including control means for controlling combustion of fuel in the combustion chamber, said control means being responsive to a plurality of remote signals to control said fuel combustion.

* * * * *